US005809582A

United States Patent [19]

Lane

[11] Patent Number: 5,809,582

[45] Date of Patent: Sep. 22, 1998

[54] LUMBAR SUPPORT ARTICLE

[76] Inventor: Frank G. Lane, P.O. Box 1104, Pottsville, Pa. 17901

[21] Appl. No.: 467,451

[22] Filed: Jun. 6, 1995

Related U.S. Application Data

[63] Continuation-in-part of Ser. No. 339,804, Nov. 15, 1994, abandoned.

[51] Int. Cl.[6] ..... E03D 11/00

[52] U.S. Cl. ..... 4/254; 297/284.5

[58] Field of Search ..... 4/254, 575.1, 579; 297/228.1, 284.1, 284.5, DIG. 6

[56] References Cited

U.S. PATENT DOCUMENTS 1,726,417 8/1929 Wren ..... 4/254
3,263,245 8/1966 Ettinger ..... 4/254
3,279,849 10/1966 Radke et al. ..... 297/284.5

FOREIGN PATENT DOCUMENTS 6225843 8/1994 Japan ..... 4/242.1

*Primary Examiner*—Charles E. Phillips
*Attorney, Agent, or Firm*—Arthur R. Eglington

[57] ABSTRACT

A lumbar back support article with a dual compartment construction, one compartment of which is adapted for mounting and interruptable fastening to a toilet lid and the adjacent second compartment is provided with a resilient cushioning element which is positioned to provide lower lumbar region support to a seated toilet user. In a preferred embodiment, the toilet lid mounting component is fabricated separately from the mateable separate cushion component with each being adapted to mate functionally to the other for use, but being handily separable from one another when desired for storing away.

6 Claims, 3 Drawing Sheets

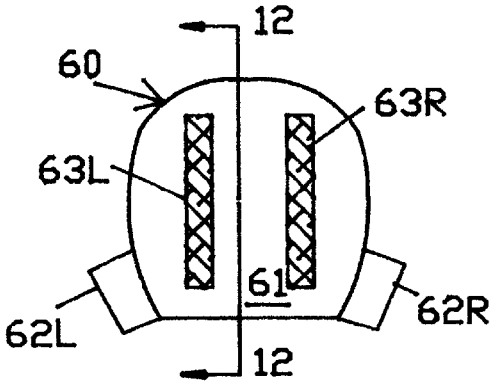
FIG. 8
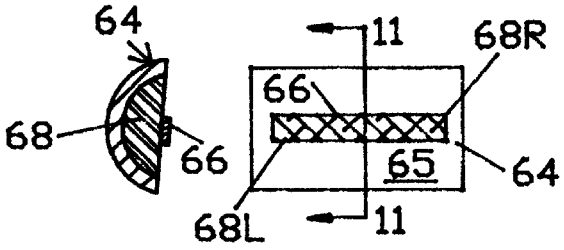
FIG. 13
FIG. 9
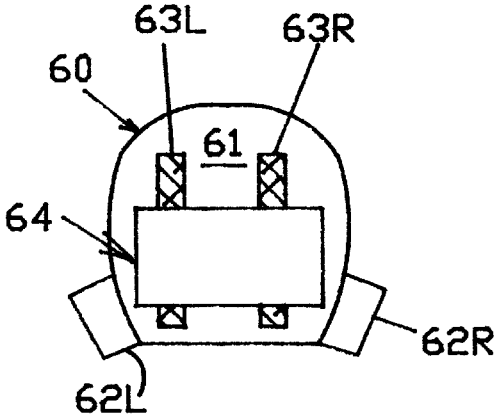
FIG. 10
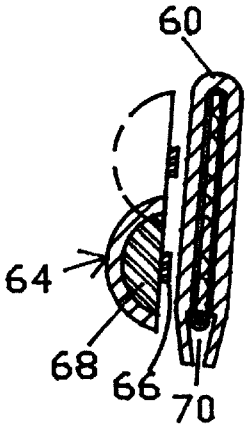
FIG. 12
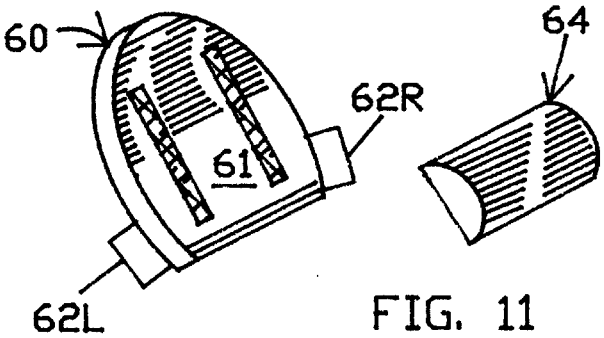
FIG. 11

LUMBAR SUPPORT ARTICLE

CROSS-REFERENCE TO OTHER APPLICATIONS

This is a continuation-in-part of my application Ser. No. 08/339,804, filed Nov. 15, 1994, now abandoned.

FIELD OF THE INVENTION

This invention relates to a back support attachment for seats, and more particularly to a specially-configured back support for the lumbar region adapted to seated toilet usage.

BACKGROUND OF THE INVENTION

Most of the seats and chairs in current use (non-cushioned) including sitting commodes, find the lower back of the occupant not being fairly supported, so that the upper torso tends to lapse into a cramped and unhealthful posture. While conventional straight back chairs have a generally flat or mildly curved backrest, they provide little or no support to the small of the back, nor any support for the lower spinal column. This is especially so with the commode lid which recline backwardly from the seating annular ring to preclude spontaneous lid slamming.

Varied types of back supports have been presented for persons suffering from back discomfort in the seated position. Such back supports serve to foster proper posture while providing semi-firm support to the user's back. Indeed, U.S. Pat. No. 2,263,245 (1966) discloses a back support attachment for toilet lids, including a sloped cushion and an integral elastic band for encircling snugly the largest horizontal dimension of the toilet lid. While perhaps effective, this is a cumbersome design, requiring not trivial manual strength to secure the elastic band straddling the lid with in a secure manner. Such product also requires a exceptional effort to detach with the same reverse effort as for the user who attaches it. It is, therefore, an object of the invention to provide a lumbar back support means readily attached to a toilet lid, aesthetically pleasing, and giving excellent support and user comfort while an occupant is in the physically-stressful posture.

Another object of the invention is to provide a handily mountable back support attachment which allows lateral lumbar support and which will conform to the anatomy of a particular user.

A still further object of the invention is to provide a backrest cushion which is portable and is easily secured to toilet lids, being comfortably firm and offers timely support for the small of the back to maintain a less stressful posture of the user.

Other and further objects and features of the present invention will become apparent to those skilled in the art from a consideration of the attached drawings, in which one preferred embodiment of the invention is illustrated, by way of example only and one which similar reference characters indicate similar parts; wherein

BRIEF DESCRIPTION OF THE DRAWING

FIG. 8 is an elevational schematic view of the front panel (torso abutting side), of another embodiment of the invention, involving a separatble but combinable toilet lid-mounting support component, again provided with the lower lateral opposing fastening tabs, these being depicted in their unsecured (and extended) positions.

FIG. 9 is an elevational view of the planar surface reverse panel (normally inwardly facing) of the separate cushion component, provided with a bound, transversely located, generally rectangular, fastening segment or strip;

FIG. 10 is an elevational front view of the support component of the front panel component, now conjoined with the cushion component (planar surface thereof being located thereon) and which is interruptibly secured thereto;

FIG. 11 is an isolated front perspective view of the lid-mounted support component and back cushion component of the invention prior to its mounting on the former;

FIG. 12 is a vertical sectional view of the support component taken along line 12—12 of FIG. 8, shown along with a like vertical section of the abutting cushion element of FIG. 11, the latter cushion component also shown in phantom as illustrative of an alternate position of the cushion component.

FIG. 13 is a vertical sectional view of the cushion component alone, taken along line 11—11 of FIG. 9; and

DETAILED DESCRIPTION OF A PREFERRED EMBODIMENT

Figure 1:
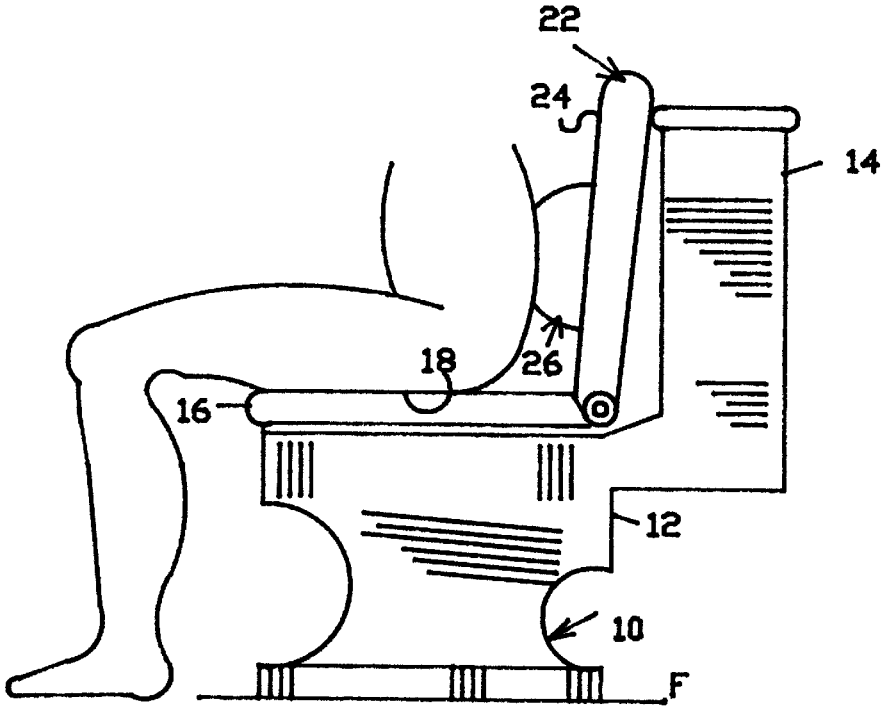
FIG. 1 is a schematic end view of the invention while in prophylactic use by an afflicted person.

Referring now to FIG. 1, a conventional toilet bowl, generally designated 10, is positioned upon a suitably modified flooring (F). The bowl 12 is provided with the usual form of an upstanding tank 14, and a conventional toilet seat 16, having a buttocks-engaging portion 18 and a hinged oval lid/cover 20. As depicted, the lid 20 (FIG. 4) has been utilized to anchor the lumbar support device 22 of the present invention. Generally, vertical lid element (not seen) which is enclosed snugly by a fabric cover 24 having one rearward compartment, which is shaped like a tennis racket cover. Secured essentially midway across the frontward surface of cover 24 is an integral, outwardly rounded cushion element 26, adapted to contact the lower back (lumbar) region of the user, while being partially compressed by the seated occupant. This compensates for the unnatural spinal column deformation which this activity necessarily imposes upon the active user.

When a user employs the modified seat of FIG. 1, his or her body is obliged to conform to the illustrated spinal column support posture, which is physiologically advantageous. This is particularly useful to those persons with a medical history of lower back pain, which is induced by any unnatural strain being placed on the person's back. The invention enables the otherwise stressed body to effect elimination without imposing the strain and discomfort normally experienced lacking the present invention.

Figure 2A:
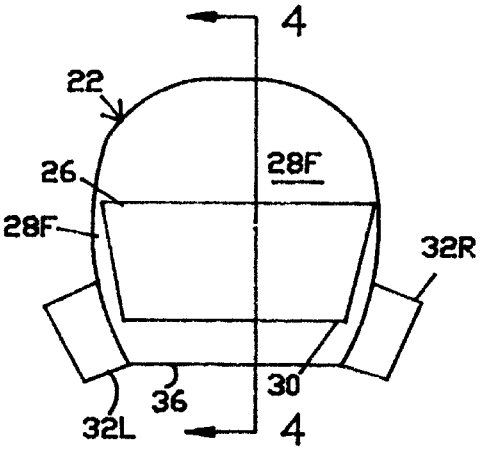
FIG. 2A is a front panel (torso side) schematic view of a preferred embodiment of the invention with its marginal fastening tabs seen in their unsecured position.
Figure 2B:
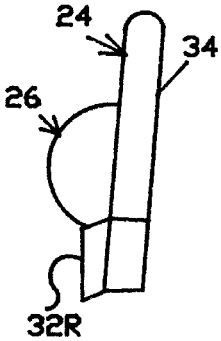
FIG. 2B is a right side end schematic view of the invention with fastening tabs unsecured and the support component shown in the uncompressed position.
Figure 2C:
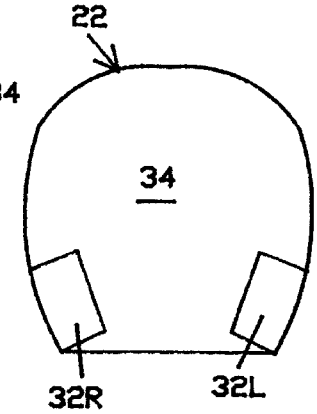
FIG. 2C is a reverse panel schematic view of the invention with fastening tabs in their lid-enclosing and securing position.
Figure 3:
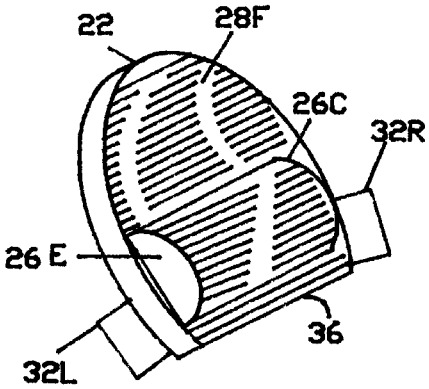
FIG. 3 is a isolated front perspective view of the invention prior to its mounting on the toilet lid.

FIGS. 2A, 2B and 2C schematically depict the article of the present invention as to its external surfaces. The frontal (torso) view of FIG. 2F shows the generally central disposition of the shaped cushion element 26, which takes up most, but not necessarily all, of the maximal horizontal width of the planar dimension 28F of the article 22. Resilient support cushion 26C itself has an essentially trapezoidal planar base 30, underlying its outwardly projecting, convex portion (FIG. 2B). Prior to assembly of the elements of the finished article, such would disclose the overall cushion form as being advantageously in the form of a semi-cylinder, with a longitudinal length averaging eleven inches (slightly less than the lid maximum width) and an average vertical width of 5.5 inches. The vertical height (radius of the semi-cylinder 26C) is between 2.5 and 3.5 inches. The facing arcuate wall 26C of that defines the first projecting compartment 26 is contiguous with the opposing common wall 28F and is secured thereto (FIG. 3). The cushion end walls 26E (FIG. 3) will be seen as being somewhat tapered from upper to lower borders, conforming then to the taper of the common wall 28F itself from its midpoint to its lowermost border 36.

A pair of opposing rectangular tabs 32L and 32R, are appended along the lower margins of the common wall 28F (FIG. 2F), with their lower edges being substantially coincident with the lower, opposing longitudinal border 36 of the article common wall. The alternate (closed) position of these tabs 32L and 32R is presented in the reverse view of FIG. 2B of the article.

The appearance to a user of the mounted and secured article is perhaps better seen in the perspective view of FIG. 3, except the tabs are seen as unsecured here solely for illustrative purposes.

Figure 5:
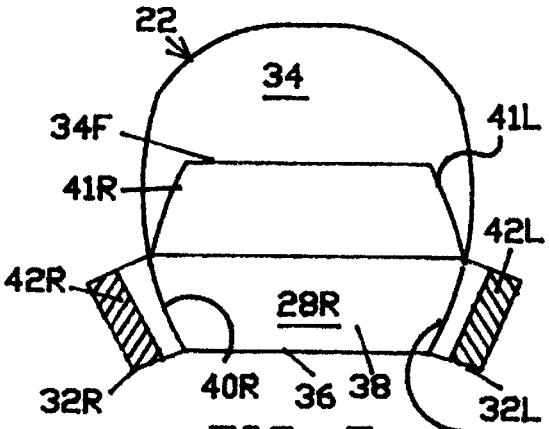
FIG. 5 is an elevational view of the invention with both marginal tabs laid open and the normally depending flap element of the support back panel folded back as it is prior to lid-enclosure.

Averting now to FIG. 5, wherein is depicted schematically the reverse (water tank side) surface 34 of the article. This oval panel has a depending, flexible segment or flap, 34F, preferably integral with the reverse panel 34 itself. Flap 34F has been folded back to reveal the lowermost portion of an oval recess 38, which recess will be slipped over the toilet lid. The elongate oval compartment 38 encloses the lid much like a covered, out-of-use tennis racket. Depending flap segment 34F is not secured to the contiguous common wall along either its lower linear border 36, nor along at least a portion of the abutting marginal segments 40L and 40R of the arcuate lateral sides (41R/C) of the common wall, presenting a roughly trapezoidal periphery. The balance of oval back wall (panel) 34 and of common wall 28R are secured permanently to one another, such as by sewing, along their outer peripheries.

In FIG. 5, the reverse surfaces of the open large tabs (32R/L) of FIG. 2(F) are now seen to each carry an essentially rectangular fastening pad 42R/42L. When back panel flap 34F is extended outwardly (FIG. 6), it then presents a second pair of fixedly mounted opposing fastening pads 44R/44L disposed on its outer margins. These panel pads each have one shorter linear end 46 arranged proximal to the unsecured lower border 36.

The pads on the open tabs (42R/L), and on the complemental pads on the back panel itself (44R/L), are aligned so as to overlap one another. When the tabs are turned inwardly they serve to engage the underlying first pair of fastener means (44R/L) mounted on the back panel 34. The resulting back panel 34 appearance (fastened) is as presented in the schematic view of FIG. 2B and 7.

The article is now lid-mounted for continuing use with the toilet; or it can be just as handily disengaged for non-users, or otherwise for aesthetic reasons.

In a preferred embodiment, the complemental pads can be of the adhering Velcro™-type fasteners. For example, the pad pair 42R/L mounted on tabs 32R/L can be of the complemental hook-locking type surface, while the spaced-apart pads 44R/L on reverse wall 34 are of the adhesive (fibrous) type material. These pad sets will engage firmly, but interruptibly, upon contact; while they are disengagable only by manual effort. These pad segments have been arrayed so as to facilitate the ready securing of the article to the toilet lid, and just as handily for the disengaging of same from the lid, when they are not needed.

Figure 4:
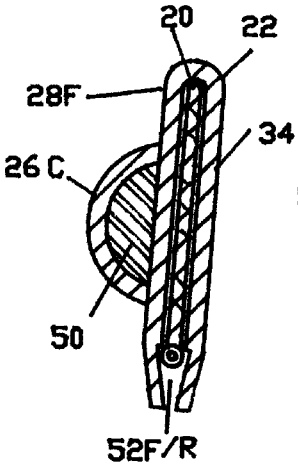
FIG. 4 is a vertical sectional view of the lower back support means taken along line 4—4 of FIG. 2(F)

The vertical sectional view of FIG. 4 (taken along lines 4—4 of FIG. 2F) depicts the differing configurations of frontal compartment 26C and of rearward compartment 52F. It will be seen that the rear elongate compartment is conformed to slip over and to firmly enclose the toilet lid. The front wall 28F of the article is, in fact, primarily a symmetrical configuration, being of a resilient, but durable fabric, such as PVC-impregnated textile fabric (laminate). Such fabric is readily cut, shaped, and sewn by means well-known in the garment fabrication arts. The elongate resilient cushion 50 is of a semicircular X-section, and may be fabricated in unit volumes by known methods; or it can be formed of foam rubber; or of foam plastic, for example, polyurethanes. Alternately, it may be made from other suitable resilient but durable materials to assure comfort to the user and to obtain considerable longevity, despite multiple flexing over years of usage.

Cushion element 50 can be mounted to the frontal panel of common wall 28F by adhesion bonding, since it remains fully enclosed within the arcuate frontal wall 26.

Optionally, frontal wall 26 can be fabricated as integral with common wall 28F, with the cushion element being placed into the cover, and an internal segment secured over the loaded pocket before the two wall peripheries are sewn together. It should be evident in the choosing of the fabric and the cutting of this panel, and upon its securing (by sewing it, or the like) along its periphery, that it is first configured to provide a sufficient horizontal depth to define a substantial closed volume, that will accommodate snugly the earlier defined dimensions of the enclosed resilient cushion element 50.

The arcuate frontal wall 26C and the common and rearward walls, 28F and 34, respectively, may be conveniently cut and sewn from the same bolt of a laminate fabric, or, they can be constructed from dissimilar fabrics. However, for purposes of visual decoration, the outer fabric surfaces may preferably be of a like design. As to the two internal lining surfaces 52F/R that enclose the toilet lid, such should advantageously be of an abrasion-resistant fabric composition, such that they will undergo multiple matings upon and removals from the lid itself, without undue abrasive wearing. A simulated leather material, composed of a moisture-impermeable outer layer bonded on a woven fabric backing layer, is a suitable flexible material to form the components of the present invention. The commercially available Naugahyde™ laminate flexible material is suitable for present component fabrication purposes.

Figure 7:
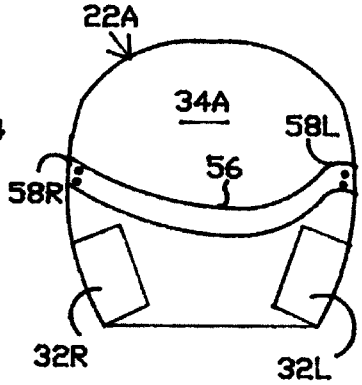
FIG. 7 is an alternate view of the reverse panel of the article of FIG. 3, in which a transverse retaining strap has been appended.

An alternate embodiment of the article of the invention is presented in the schematic view of FIG. 7. The only added element is a flexible fabric strap 56, which is positioned horizontally across the widest portion of the back wall (34A). It is secured at its longitudinal end 58R/58L to the diametrically opposing edges of this back wall. This strap permits the lumbar cushion to be mounted upon either on an automobile seat, or upon a straight-backed chair. This strapping means is an alternative to use of the internal recess 38 of FIG. 4, which is preferentially needed for mounting on a toilet seat lid.

An alternate means for constructing cushion 64 would be to provide an open seam along one longitudinal dimension. This linear edge would be provided with several spaced-apart, matching sets of complemental Velcro™ tabs (like the cover-closing tabs shown in FIGS. 5 and 6). These paired tabs (not shown) will permit access to the internal chamber of the cushion, permitting substitution of a fresh preformed member, as the original member may lose resiliency over the course of extended usage.

Still another embodiment is presented in the schematic views of FIGS. 8–13, in which the fabric support component and the cushion component have been fabricated quite separately, but are handily adapted, according to the invention, to be functionally integrated when in use; and further, to provide for lumbar region support in a more flexible manner, that is, by permitting variation of the vertical height of the cushion along the support component, at which the cushion component is transversely mounted, by means to be described.

Figure 6:
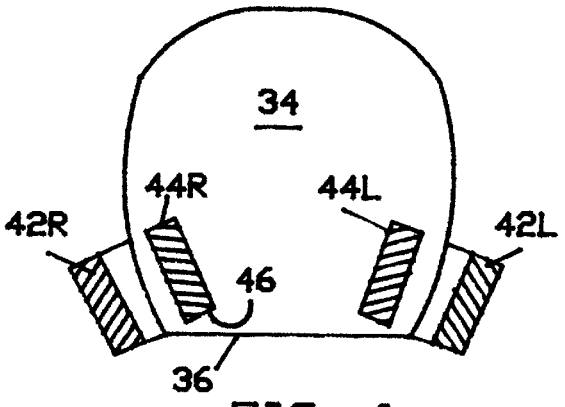
FIG. 6 is another schematic view of the reverse support panel but with the flap fully extended, depicting the companion pads of the fastener means, which are affixed to the outer and lower margins of the support panel.

With regard to the reverse side of the support component of FIG. 8, its construction and utilization are identical with the same side on the first embodiment, and is as depicted in FIGS. 5 and 6.

Averting briefly to FIGS. 5 and 6, there is presented, respectively, the open and hang down positions for the depending flap 34F. This reverse side panel 34F is structurally identical with the reverse panel (shown) of the embodiment of FIG. 8 (not shown); so, the detailed configuration enclosure of the FIG. 8 embodiment will not be reiterated here as it is well described in relation to the first embodiment of FIGS. 5 and 6. It will suffice to recall that when component 10 is mounted on a toilet lid, at lower flap 62L and 62R are folded inwardly and will engage securely the underlining adhesive strips, such as pile-like pads 44R and 44L of FIG. 6 and thus will then appear as they do in FIG. 2B.

Regarding the embodiment of FIGS. 8–13, it will now be described in detail. Note that the panel of FIG. 8 is the functional equivalent of the panel element 28F depicted in FIG. 2F/3 for the first embodiment. The lid-mounting element 60 has a similar ovoid shape, adapted to enclose snugly a standard toilet lid (not seen). Along its lower lateral sides, are seen opposing rectangular tabs 62L and 62R, each appended securely along one edge to the lower periphery of front panel 61. The alternate (closed) position of tab 62L/62R is exactly as was presented in for the reverse side view of FIG. 2B for like tabs 32R and 32L. The article appearance to a toilet user is better seen in the elevational view of FIG. 10 of the assembled components with cushion component 64 mounted thereon.

Panel surface 61 is provided with a pair (63L/63R) of spaced-apart, substantially parallel, elongate strips affixed thereto, both presenting identically constricted adhering segments, preferably, but not necessarily, of the pile-like type (VELCRO™ zippers).

Averting now to FIG. 9, there is presented the planar surface 65 of cushion component 64. Planar surface 65 is provided with at least one bound elongate strip 66 (preferably of the hook-locking type), which is affixed transversely thereon. It is of a sufficient linear length, 68L to 68R, so as to overlap completely and to engage the parallel vertical strips 63L and 63R, positioned on the front panel 61 of lid-mounted component 60. As the exposed strips (63L/13R) are identical in construction, so when they are made confrontational with cushion transverse strip 65, they will engage and hold the complemental cushion element 64 securely upon the planar panel 61, as is depicted in FIG. 10. Lateral flaps 62L/62R are then folded back upon the reverse panel, to contain the conjoined components fully braced on the lid, as seen in the mode of FIG. 2B.

The convex cross-section for the longitudinal semicylindrical configuration of cushion 64 is better seen in FIG. 11/13. The preformed resilient element 68 is of a flexible foam material, like low density polyurethane compoistion. The elongate adhering strip 66 is shown to project somewhat outwardly of the planar surface 65. The vertical cross-sectional view of the conjoined components mounted on toilet lid 70 is presented in FIG. 12. Note how support component 60 is snugly mounted on lid 70, while moveable cushion element 64 still retains a range of vertical securing postures. These serveral cushion postures will serve to adapt the backrest article to the variable back heights and the predilections of a user needing lumbar support.

In a preferred embodiment, strips 63L/63R may be of the fastening pile type (VELCRO™ form), while the transverse adhering strip 66 is of the complemental hook-locking type. It is practical to switch the type of fastening/adhering character as convenience of fabrication dicates. In either case, these complemental selection of strips/pads can then engage firmly, but interupptibly, upon contact.

It will now be apparent that a streamlined and convenient back support for the lumbar region of the human back has been provided by this invention. It is firm but yieldable to physical pressure while it supports the human torso, in a position that provides comfort and obviates unneeded stress to a susceptible user. It thus precludes the triggering of pain in the lower back and/or in the upper legs.

While the invention has been described with reference to a preferred embodiment, it is to be noted that the description is illustrative, and the invention scope is limited only by the appended claims.

I claim:

1. A lumbar region backrest article adapted for use with a standard toilet lid and its cooperating annular seat, the back rest being defined by a two-component article comprising, (a) firstly, a textile fabric material, lid-mounting component consisting of first and second truncated, generally oval shaped flexible panels of like configuration, which are superimposed and are peripherally secured to one another along their upper and most of the lateral peripheries, thereby defining an external surface on each panel and a first, limited access compartment; and (b) secondly, a resilient lumbar support cushion component having an essentially planar base and having a generally semi-cylindrical outwardly projecting convex portion, with closed endwalls, the resulting scaled second compartment adapted to retain a preformed resilient material, serving to provide a normally convex contour to said cushion component, which resilient material is also adapted to being compressed deformably upon torso pressure; further comprising:

(i.) a first pair of spaced-apart, substantially parallel, elongate strips affixed to an outer surface of said fast panel of the lid-mounting component, the external strip surfaces presenting similarly configured adhering segments of one of hook and loop materials; said second flexible panel being unsecured to said first panel along the line of truncation and upwardly along a portion of said oval configuration, thus defining a retractable flap that facilitates placement of the lid mounting component snugly about the widest dimension of the toilet lid;

(ii.) a second pair of spaced-apart adhering strips of one of hook and loop materials, fixedly mounted adjacent with the lateral margins of the external surface of the depending planar segment of the second panel, with each of such pairs having one of its longitudinal ends located proximal to the line of truncation of the retractable flap;

(iii.) a pair of outwardly extending, flexible tabs, each being secured along one of their linear dimensions to a lowermost lateral periphery of said first panel, with each tab adapted to overlap the adjacent lateral margins of the retractable flap to cover the area presenting one of said second pair of adhering strips;

(iv.) a complemental pair of fastening means of the other of the hook and loop materials, mounted fixedly on a respective flexible tab, and positioned to contact and interruptibly engage one of said second pair of adhering strips mounted on said flap; and (v.) at least one elongate adhering strip of the other of said hook and loop materials affixed transversely on the planar surface of the cushion component, being of a linear dimension sufficient to overlap and engage the first pair of parallel adhering strips, positioned on the external surface of said first panel of the lid-mounted component; and further serving to permit using any of a plurality of vertically oriented positions for the transverse cushion component to be securely supported by the first pair of elongate strips affixed to the lid-mounted component, whereby the assembled article presents an outwardly projecting cushion element providing lumbar region support, and having an inherent resiliency suited to yield substantially to compression imposed from the torso of a seated user.

2. The back rest of claim 1 wherein said semicylindrical-shaped, lumbar-engaging cushion element has a uniform radius of curvature of 6.35 to 8.9 cm (2.5 to 3.5 inches) centered along the midline of substantially all of its planar dimension.

3. The back rest of claim 1 wherein said cushion element has the resiliency provided by a flexible foam material.

4. The back rest of claim 1 wherein the foam material is of low density polyurethane composition.

5. The back rest of claim 1 wherein the outward surfaces of both the first and second planar walls are fabricated from a durable sheet-like material.

6. A lumbar support backrest of claim 1 wherein a flexible strap is positioned substantially horizontally across the widest portion of the back wall and is secured to the opposing edges thereof.

* * * * *